US007349789B2

(12) United States Patent
Pettersson

(10) Patent No.: US 7,349,789 B2
(45) Date of Patent: Mar. 25, 2008

(54) METHOD FOR CONTROLLING SUPPLY OF FUEL TO A COMBUSTION ENGINE

(75) Inventor: Magnus Pettersson, Södertälje (SE)

(73) Assignee: Scania CV AB (publ) (SE)

( * ) Notice: Subject to any disclaimer, the term of this patent is extended or adjusted under 35 U.S.C. 154(b) by 381 days.

(21) Appl. No.: 10/536,604

(22) PCT Filed: Nov. 24, 2003

(86) PCT No.: PCT/SE03/01810

§ 371 (c)(1),
(2), (4) Date: May 24, 2005

(87) PCT Pub. No.: WO2004/048764

PCT Pub. Date: Jun. 10, 2004

(65) Prior Publication Data

US 2006/0136114 A1 Jun. 22, 2006

(30) Foreign Application Priority Data

Nov. 26, 2002 (SE) ..... 0203476

(51) Int. Cl.
*F02D 41/30* (2006.01)

(52) U.S. Cl. ..... 701/104

(58) Field of Classification Search ..... 701/104, 701/102, 105, 103; 123/478, 480, 481, 198 F
See application file for complete search history.

(56) References Cited

U.S. PATENT DOCUMENTS 4,257,371 A * 3/1981 Ishida ..... 123/198 F
4,941,442 A 7/1990 Nanyoshi et al. ..... 123/333
5,131,371 A 7/1992 Wahl et al. ..... 123/436
5,775,296 A 7/1998 Goras et al. ..... 123/406.47
6,170,468 B1 * 1/2001 Wada ..... 123/476

FOREIGN PATENT DOCUMENTS

JP 8291728 11/1996
JP 11-141377 A * 5/1999

OTHER PUBLICATIONS

International Search Report for PCT/SE2003/001810 dated Feb. 2, 2004.

* cited by examiner

*Primary Examiner*—Hieu T. Vo
(74) *Attorney, Agent, or Firm*—Ostrolenk, Faber, Gerb & Soffen, LLP

(57) ABSTRACT

A method for controlling supply of fuel to a combustion engine, e.g. a self-igniting internal combustion engine in a vehicle, having a first group of cylinders and a second group of cylinders, the method comprising the steps of: determining if a demanded total fuel quantity to the combustion engine is below a first predetermined total fuel quantity; and, if the demanded total fuel quantity to the combustion engine is below the first predetermined total fuel quantity, increasing the fuel supply to the first group of cylinders with a value determined by the demanded total fuel quantity and decreasing the fuel supply to the second group of cylinders with substantially the same value. Also, a second method, a computer program and an electronic control unit.

14 Claims, 4 Drawing Sheets

METHOD FOR CONTROLLING SUPPLY OF FUEL TO A COMBUSTION ENGINE

CROSS REFERENCE TO RELATED APPLICATION

The present application is a 35 U.S.C. §§ 371 national phase conversion of PCT/SE2003/001810 filed 24 Nov. 2003, which claims priority of Swedish Application No. 0203476-7 filed 26 Nov. 2002. The PCT International Application was published in the English language.

TECHNICAL FIELD OF THE INVENTION

The present invention relates to methods for controlling fuel supply to a combustion engine. The invention also relates to a computer program, an ECU (Electronic Control Unit) and a computer program product for performing the methods.

BACKGROUND OF THE INVENTION

Electronic control of fuel injection to combustion engines in vehicles is used today due to the advantages enabled through the electronic control in comparison with a mechanical control system. Electronic control has significantly contributed to make e.g. the diesel engine more powerful, more efficient, cleaner and quieter. U.S. Pat. No. 5,131,371-A discloses a part of such an electronic control system for a diesel engine.

A demanded fuel supply to a diesel engine is typically substantially proportional to a requested engine torque. The actual fuel supplied to the cylinders of the engine shall ideally be directly proportional to the demanded fuel supply. Hence the actual fuel supply shall ideally be proportional to the requested engine torque. However, in some fuel injection systems the correspondence between the actual fuel supply and the demanded fuel supply has not been satisfying during certain work conditions and demanded fuel quantities. This unsatisfying correspondence is caused by hydraulic instability in the fuel injection system, where the hydraulic instability may be caused e.g. when a fuel quantity control valve in the fuel injection system closes a fuel passage in the valve. The valve may for instance comprise a closing means, which is forced against a stop surface when closing the passage. The passage needs to be closed rapidly and the closing means may therefore bounce on the stop surface when closing the passage, thus enabling undesired leakage of fuel through the passage. This leakage causes the actual fuel quantity to differ from the demanded fuel quantity. If the demanded fuel quantity is small, the leakage is relatively high compared to the demanded fuel quantity. This makes the fuel injection control more difficult. A driver of the vehicle experiences the hydraulic instability through e.g. undesirable and distracting noise.

In some systems, hydraulic instability causes problems when a small increase of fuel supply is demanded and the current fuel supply is relatively low. The hydraulic instability here causes a decrease of torque and actual fuel supply although a higher fuel supply than in the injection cycle before is demanded (see also FIG. 1). To avoid the danger of an unstable fuel injection control system caused by this non-linear correspondence between the demanded fuel supply and the actual fuel supply, the fuel injection control system must be more stability robust than it would have to be if the non-linearity would not exist. There also has to be higher demands on the insensitivity of the fuel injection control system in order to keep it sufficiently accurate and reject disturbances. A way to compensate for the non-linearity is to develop a compensation routine for the control system, but this adds to the complexity and the computing time and is not accurate since the range of non-linearity depends on the individual vehicle configuration and the temperature of the fuel.

In order to avoid the hydraulic instability problems during the most frequently used driving conditions, fuel injection systems usually are designed in such a way that the hydraulic instability affects the fuel injection system within a range of low engine torque values. The fuel supply in this range is preferably designed to be lower than the fuel supply during idle speed. Hydraulic instability is however likely to affect the fuel supply also in ranges above idle speed. There are driving conditions wherein the fuel supply may be within the ranges where instability occurs, such as during cruise control at relatively low engine torque and during electronically controlled automatic or semi-automatic gear shifting in a smooth way.

SUMMARY OF THE INVENTION

An object of the present invention is to decrease vibration and noise caused by a combustion engine during certain driving conditions in e.g. a vehicle, such as during cruise control at relatively low engine torque and when automatically or semi-automatically shifting gear through a gearbox connected to the engine.

Another object of the invention is to enable a stability robust and insensitive control system also in fuel quantity ranges where hydraulic instability occurs.

Yet another object of the invention is to enable smoother driving of an engine during certain driving conditions.

The invention relates to a method for controlling supply of fuel to a combustion engine, e.g. a self-igniting internal combustion engine in a vehicle, having a first group of cylinders and a second group of cylinders. The method comprises according to a first aspect the steps of:

determining if a demanded total fuel quantity to the combustion engine is below a first predetermined total fuel quantity;

and, if the demanded total fuel quantity to the combustion engine is below the first predetermined total fuel quantity, increasing the fuel supply to the first group of cylinders with a value determined by the demanded total fuel quantity and decreasing the fuel supply to the second group of cylinders with substantially the same value. The value shall here of course be understood as an absolute value. Through the method it is achieved that a fuel quantity range or ranges below the first predetermined total fuel quantity and in which range/ranges hydraulic instability occurs may be avoided by letting the fuel quantity injected into the first group of cylinders be above the range and the fuel quantity injected into the second group of cylinders be below the range, without affecting the average fuel quantity injected into the cylinders. To group all or some of the cylinders of the engine into the first and the second group shall be understood as any predetermined grouping of the cylinders, regardless of the basis for the grouping. The cylinders can belong to one of the first and second group due to e.g. physical position related to each other; a common fuel quantity actuator; other hydraulic, pneumatic or electric control means in common; and due to any other predetermine constructional or abstract "rule" implemented for the control of the engine, such as ignition order, where e.g. every second cylinder in the ignition order belongs to the first group and the remaining cylinders belong to the second group.

The value may be reciprocally proportional to the demanded total fuel quantity on at least a part of a demanded total fuel quantity range between zero demanded total fuel quantity and the first predetermined total fuel quantity. Hereby is achieved that that the increase and decrease respectively injected into the cylinders for at least a part of the total fuel quantity range increase as the demanded total fuel quantity becomes lower.

The value may be reciprocally proportional to the demanded total fuel quantity in the whole demanded total fuel quantity range between a second predetermined total fuel quantity and the first predetermined total fuel quantity. Hereby is achieved that the relative increase of an offset from a mean fuel quantity for the cylinder increases when the demanded total fuel quantity decreases.

The value may also be highest and constant in a demanded total fuel quantity range between a second predetermined total fuel quantity and a third predetermined total fuel quantity, which is larger than the second predetermined total fuel quantity, but smaller than the first predetermined total fuel quantity.

The method may according to a second aspect comprise the steps of:

determining if a demanded fuel quantity to a cylinder is below a first predetermined fuel quantity;

and, if the demanded fuel quantity to the cylinder is below the first predetermined fuel quantity, increasing the fuel supply to the first group of cylinders with a value determined by the demanded fuel quantity and decreasing the fuel supply to the second group of cylinders with substantially the same value.

The value may also here be reciprocally proportional to the demanded fuel quantity on at least a part of a demanded fuel quantity range between zero demanded fuel quantity and the first predetermined fuel quantity.

The value may here be reciprocally proportional to the demanded fuel quantity in the whole demanded fuel quantity range between a second predetermined fuel quantity and the first predetermined fuel quantity, the second predetermined fuel quantity being smaller than the first predetermined fuel quantity.

The value may be highest and constant in a demanded fuel quantity range between a second predetermined fuel quantity and a third predetermined fuel quantity, which is larger than the second predetermined fuel quantity, but smaller than the first predetermined fuel quantity. The second predetermined fuel quantity may be the zero demanded fuel quantity.

The fuel supply may be increased to every two cylinders of all cylinders of the engine and decreased to the other cylinders of the engine according to an ignition order for all the cylinders of the engine. Hereby is achieved that a relatively even torque is provided by the engine compared to an embodiment where the decrease and increase of the fuel supply to the respective cylinders is distributed in another way.

The value may for some embodiments always be less than 100%. Hereby is achieved that the fuel supply to the cylinders of the second group is not shut off completely.

The steps of the method may be performed during at least a part of a gear shifting procedure controlled by an electronic control unit for semi-automatic or automatic gear shifting.

The steps of the method may alternatively or in addition be performed when an automatic cruise control system for a vehicle controls the combustion engine.

The method also relates to a computer program comprising computer readable code means, which when run on a computer for controlling fuel supply to a combustion engine cause the computer to perform the steps of the first or second aspect of the method.

Furthermore, the invention relates to an ECU in a vehicle for controlling fuel supply to a combustion engine in the vehicle. The ECU comprises a storing means and the computer program recorded thereon.

Moreover the invention relates to a computer program product, comprising a computer readable medium, which comprises the computer program. The computer program product may be a floppy disc, a DVD, a CD, a hard disk or any other non-volatile memory.

BRIEF DESCRIPTION OF THE DRAWINGS

The objects, advantages and effects as well as features of the present invention will be more readily understood from the following detailed description when read together with the accompanying drawings, in which.

DETAILED DESCRIPTION OF EMBODIMENTS

Figure 1:
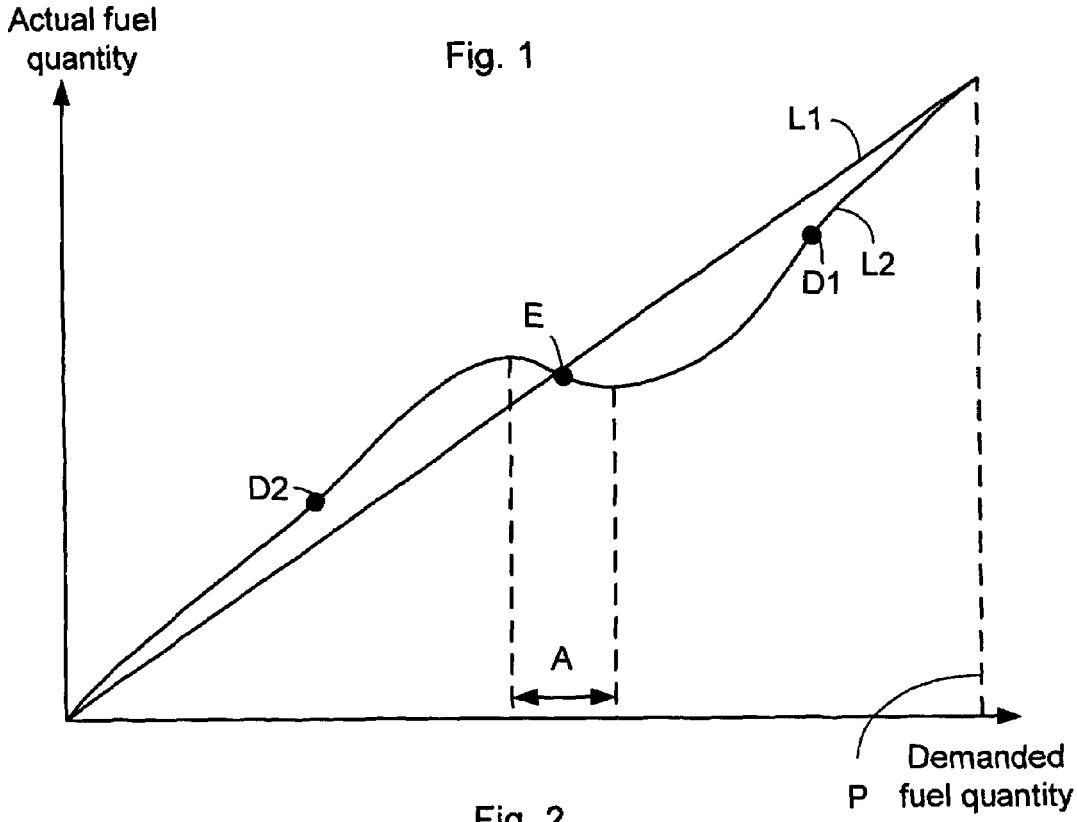
FIG. 1 is a diagram showing the actual fuel supply to one cylinder as a function of a demanded fuel supply to that cylinder.

While the invention covers various modifications and alternative constructions, some embodiments of the invention are shown in the drawings and will hereinafter be described in detail. However it is to be understood that the specific description and drawings are not intended to limit the invention to the specific forms disclosed. On the contrary, it is intended that the scope of the claimed invention includes all modifications and alternative constructions thereof falling within the spirit and scope of the invention as expressed in the appended claims to the full range of their equivalents.

FIG. 1 shows an actual fuel quantity injected into a cylinder of an internal combustion engine in a vehicle as a function of the demanded fuel quantity for that cylinder. The figure could for a diesel engine as well show an actual engine torque contribution from the cylinder as a function of a demanded torque contribution, since injected fuel quantity is closely related to the engine torque. It is to be understood that the term 'fuel quantity' in the rest of the specification, including the claims, could be replaced by 'engine torque' when applied to a diesel engine, since the spirit of the invention is the same regardless of whether 'fuel quantity' or engine torque' is referred to regarding diesel engines. Line L1 shows the ideal, linear correspondence between the demanded fuel quantity and the actual fuel quantity. Line L2 is an example of a real correspondence between the demanded fuel quantity and the actual fuel quantity at relatively low fuel quantities. Due to hydraulic instability, an increased demand of fuel within a fuel quantity range A gives a decreased actual quantity of fuel. Thus it is undesirable to let the cylinders of the engine work in this range for reasons mentioned above.

Figure 2:
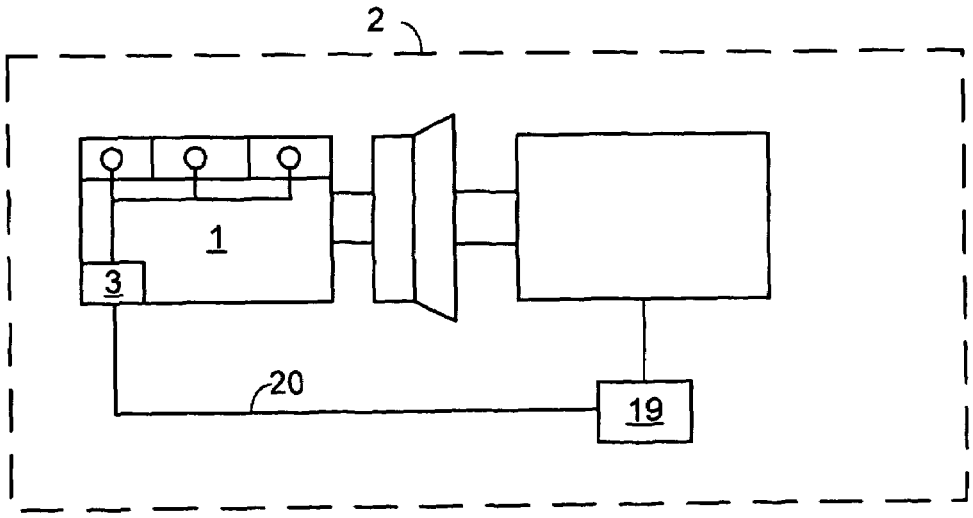
FIG. 2 is a schematic block diagram of a system according to one embodiment of the invention.

FIG. 2 schematically shows a combustion engine 1 in the form of an internal diesel engine in a vehicle 2, such as a truck and a bus, equipped with an even number of cylinders. The invention may be used in any suitable fuel injection system, such as an UPS (Unit Pump System), a CRS (Common Rail System) and an UIS (Unit Injector system). An ECU 3 with an engine control computer program controls the fuel quantity injected into each cylinder and may e.g. in the case of an UIS be electronically connected to valves positioned in e.g. each unit injector or at another position upstream the unit injectors for control of the fuel injection.

Figure 3:
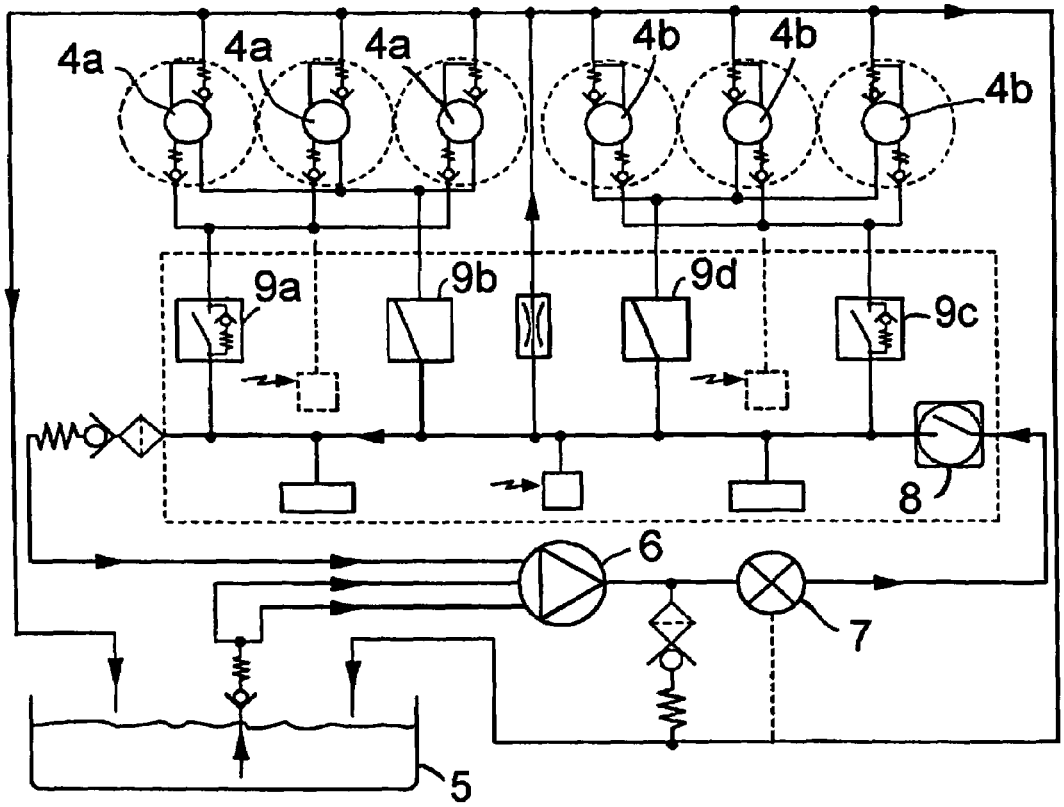
FIG. 3 is an outline diagram of a fuel injection system that can be used together with the invention, FIG. 4 schematically shows an ECU for controlling the engine according to the invention.

FIG. 3 is an outline diagram of the hydraulic part of an exemplary UIS in which the invention can be utilised. In this example the engine 1 comprises six cylinders 4*a*-4*b* with an associated unit injector each. Fuel is taken from a fuel tank 5 by a feed pump 6, which forces the fuel through a fuel filter 7 and a stop-valve 8. As can be seen in FIG. 3, the unit injectors and thereby also the cylinders are hydraulically divided into a first group and a second group with three cylinders/fuel injectors each, 4*a* and 4*b* respectively. The fuel quantity supply and the fuel injection time for the cylinders 4*a* in the first group is controlled by the ECU 3 through two actuators 9*a*-9*b* downstream of the stop-valve 8, where one of the actuators, 9*b*, is used for controlling the fuel injection time and the other, 9*a*, is used for controlling injected fuel quantity. In the same way, two other actuators 9*c*-9*d* positioned downstream of the stop valve 8 and hydraulically parallel with the first two actuators 9*a*-9*b* are used by the ECU 3 to control the fuel injection time and the injected fuel quantity to the cylinders 4*b* of the second group. The actuators are for instance magnetic valves.

Figure 4:
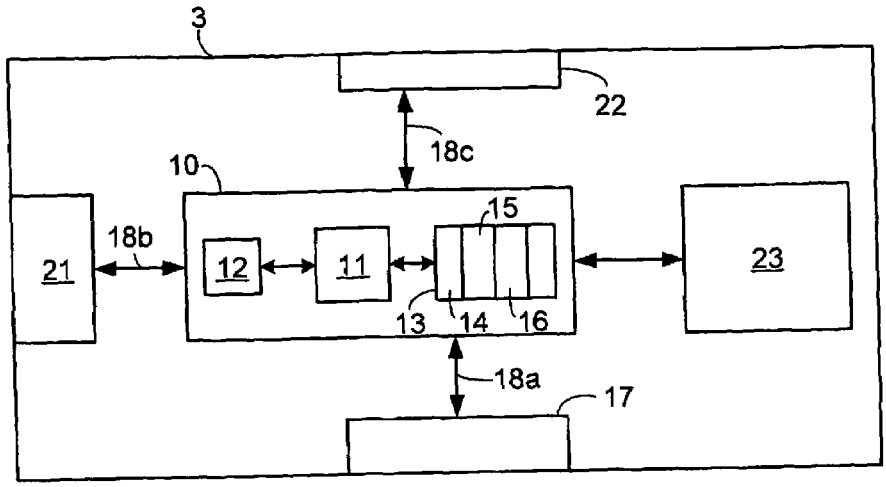

FIG. 4 schematically shows the ECU 3, which comprises a microcontroller 10, which in this embodiment comprises a CPU (Central Processing Unit) and RAM (Random Access Memory) and at least one non-volatile memory 13, such as a ROM (Read-only Memory), an EPROM (Erasable Programmable Read Only memory) and a Flash memory. An engine control computer program 14 is stored in the non-volatile memory and causes the ECU 3 to inter alia control the fuel injection to the engine 1. Other software may as well be stored in the non-volatile memory 13, e.g., a cruise control computer program 15 and a vehicle speed limiting computer program 16. The microcontroller 10 is connected to a CAN (Controller Area Network) interface 17 via a first databus 18*a* for communication with other ECUs, such as ECUs for an automatic gearbox system 19 (see FIG. 2), brake system and adaptive cruise control system, via a vehicle internal CAN 20 (see FIG. 2). The microcontroller 10 is also connected to input signal circuitry 21 via a second data bus 18*b* for receiving signal from different ECU internal and external sensors (not shown) connected directly to the ECU 3 and output signal circuitry 22 via a third data bus 18*c* for operating and sending signals to the actuators 9*a*-9*d* as well as other actuators and relays. Furthermore, several types of data storing means/computer program products 23 may be connected to the microcontroller 10 through a fourth data bus 18*d*. Such a storing means 23 may be an EEPROM (Electrically Erasable Programmable Read Only Memory), a second ROM or a hard disk.

Figure 5:
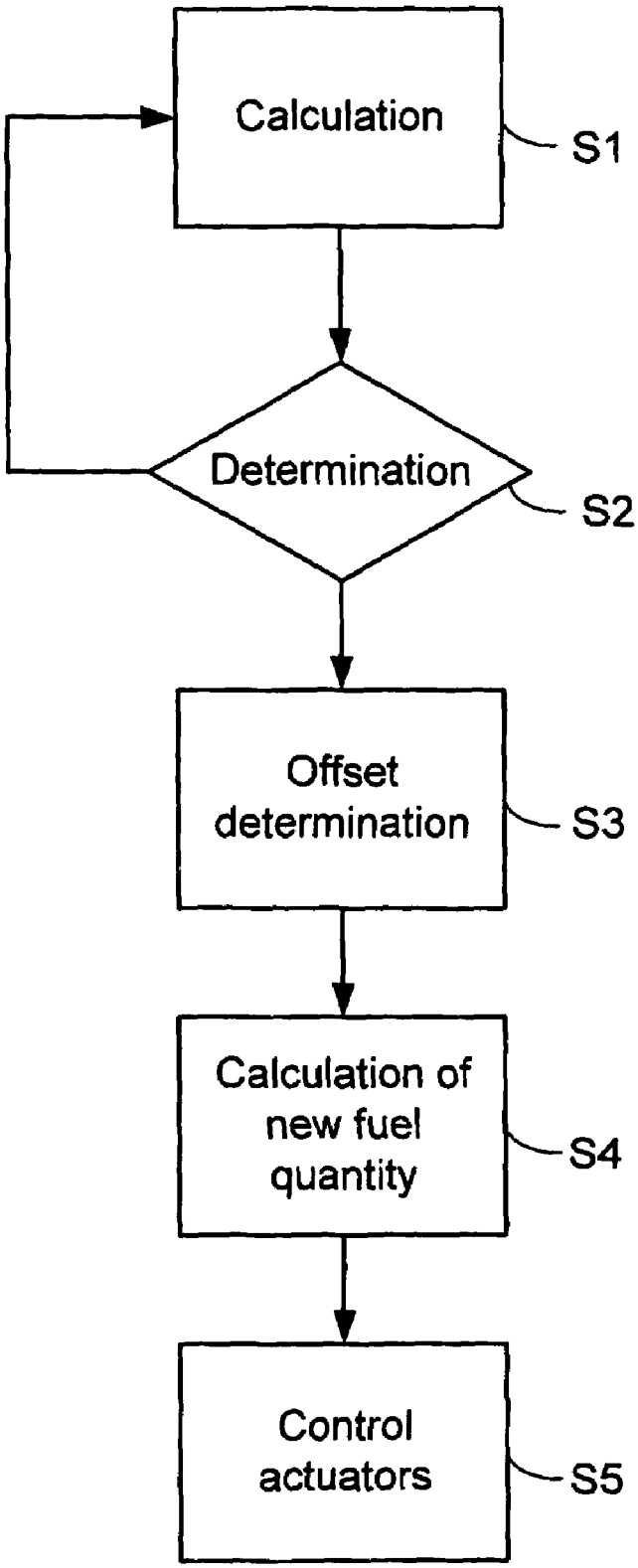
FIG. 5 is a schematic flow diagram for a method according to the invention.

Having described an embodiment of a system in which a method according to the invention may be implementet, a method according to the invention will now be described in conjunction with FIG. 1, FIG. 5 and FIG. 6. It must be understood that the method described here can be incorporated and used in combination with known computer program modules that may be comprised in the engine control computer program 14. Examples of such computer program modules are an injected-fuel quantity limiting module, an idle speed control module, engine start control module, an intermediate-speed control module and an injected-fuel quantity compensation module. In a first step S1 of a first aspect of a method, an instantaneous, demanded total fuel quantity is calculated by the ECU 3 when the engine 1 is running. The demanded total fuel quantity is affected by signals from sensors such as an accelerator pedal sensor and an engine speed sensor and signals from other vehicle systems such as a braking system, a stability system, and a traction control system. The manual engine power demand indicated by the accelerator pedal sensor may also be overridden by a cruise control system, a vehicle speed limiting system or an automatic or semi-automatic gear shifting system. The calculation itself depends upon maps, which also take other influences into account, such as fuel and intake-air temperature. The maps and the calculation are as such known in the art and are therefore not described more in detail. According to a second aspect of the method, an individual demanded fuel quantity for each cylinder is calculated in addition or alternatively to the demanded total fuel quantity. The demanded fuel quantity for a cylinder may e.g. be calculated by dividing the demanded total fuel quantity with the number of cylinders.

Instead of the ECU 3, other ECUs such as the ECU 19 for an automatic or semi-automatic gear shifting system may perform the calculation in step S1 and send the output to the ECU 3. In other words, the method is not dependent upon where the calculation is performed as long as the unit that performs the calculation is connected to the ECU 3.

After step S1, the method continues with a second step S2, in which, according to the second aspect, it is determined if the demanded fuel quantity for a cylinder, is below a value equal to a first predetermined fuel quantity P. According to the first aspect, it is determined if the demanded total fuel quantity to all the cylinders 4*a*-4*b* is below a value equal to the first predetermined fuel quantity P times the number of cylinders. The first predetermined fuel quantity P may be below the required fuel quantity for idle speed I (see FIG. 1) but may also be set to any value above the idle speed dependent on e.g. the type of utilised fuel injection system and driving condition in which the hydraulic instability is likely to occur. If the demanded fuel quantity is above the first predetermined fuel quantity P and the demanded total fuel quantity is above the first predetermined fuel quantity times the number of cylinders respectively, no adjustment of the demanded fuel quantity to each cylinder 4*a*-4*b* is considered necessary and the method returns to step S1. If the demanded fuel quantity is below the first predetermined fuel quantity P and the demanded total fuel quantity is above the first predetermined fuel quantity times the number of cylinders respectively, the method continues with a third step S3.

In step S3, a value of an increase or decrease of the fuel quantity distributed to each cylinder 4*a*-4*b* is determined by the ECU 3. There is no change of the demanded total fuel quantity calculated in step S1, but the substantially equal quantity distributed to each cylinder 4*a*-4*b* is going to be changed into an unequal distribution between the cylinders 4*a*-4*b*. In the system described above, an increase of the fuel supply to the first group of cylinders 4*a* is determined according to a curve/map stored in the ECU 3 and described below in conjunction with FIG. 6. In order to substantially preserve the demanded total fuel quantity to the engine 1, a decrease of the fuel supply to the second group 4*b* is also determined, where the decrease is substantially equal to the fuel supply increase for the first group.

In a fourth step S4, subsequent to step S3, the fuel supply to each cylinder 4*a*-4*b* is calculated using the increase and decrease determined in step S3. In the case of a system according to FIG. 3, it is only necessary to calculate the fuel supply to each group and thereby simplify the calculation and indirectly calculate the fuel supply to each cylinder 4*a*-4*b* as each cylinder in a specific group is supplied with a substantially equal amount of fuel for a stroke cycle for which the calculation has been performed.

In step S5 after step S4, the ECU 3 controls the actuators in order to supply the fuel, which was calculated in step S4, to each cylinder. After step S5, the method returns to step S1.

Figure 6:
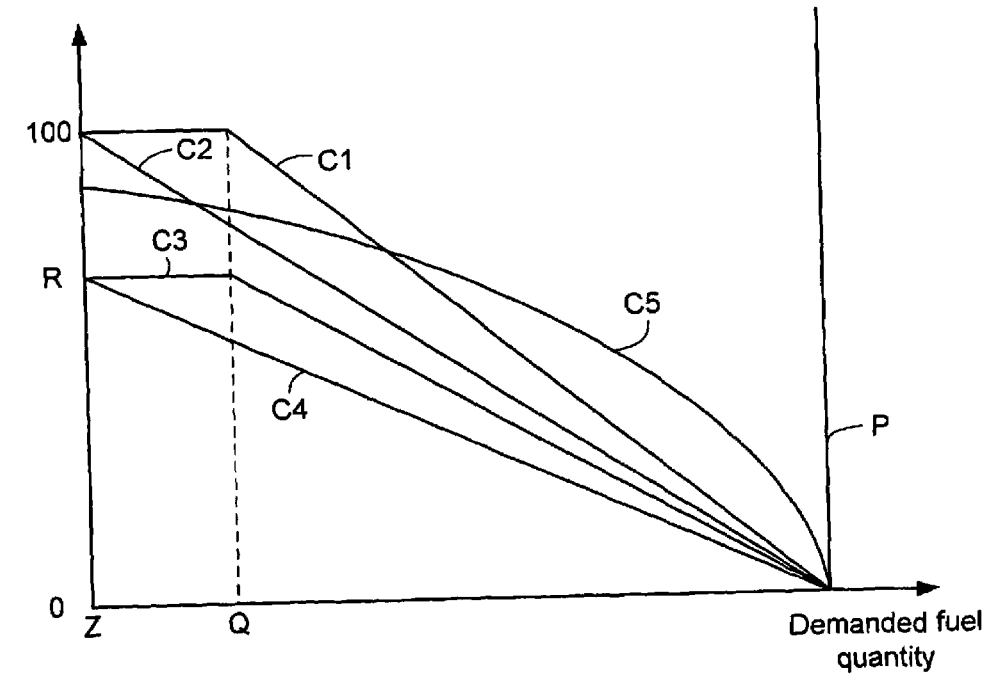
FIG. 6 is a diagram showing offset profiles according to the invention.

FIG. 6 discloses a fuel supply offset for a cylinder as a function of the demanded fuel supply for that cylinder as it was calculated in step S1 in the second aspect of the method. The offset means a decrease of the fuel supply to the cylinder if the cylinders belong to the second group and an increase if the cylinder belongs to the first group. 100% offset means a 100% decrease or 100% increase of fuel supply to the cylinder and thereby no fuel supply at all to the cylinder if the cylinder belongs to the second group or a doubled fuel supply to the cylinder if the cylinder belongs to the first group. Correspondingly 0% offset means no decrease or increase of the fuel supply to the cylinder. A first curve C1 shows a correspondence according to a first embodiment and comprises a straight horizontal part at the level of a 100% offset for a demanded fuel supply calculated in step S1 and being between a second predetermined fuel quantity Z, which may be zero and a third predetermined fuel quantity Q, which is smaller than the first predetermined fuel quantity P, but larger than the second predetermined fuel quantity Z. In the range between Q and P, there is a reciprocally proportional correspondence between the demanded total fuel supply and the offset. This is shown as a straight, inclined second part of the first curve C1, where the offset is 100% at the third predetermined fuel quantity Q and 0% at the first predetermined fuel quantity P.

An inclined, straight, second curve C2 shows a second embodiment in which the offset is reciprocally proportional to the demanded fuel quantity calculated in S1 in the fuel quantity range between the second predetermined fuel quantity Z and the first predetermined fuel quantity P. The offset is 100% at the second predetermined fuel quantity Z and zero when the demanded fuel quantity is equal to the first predetermined fuel quantity P.

A third curve C3, represent a third embodiment similar to the first curve C1, but here a straight horizontal part of C3 between the second predetermined fuel quantity Z and the third predetermined fuel quantity Q shows a smaller offset R, i.e. below 100%. In the range between Q and P, there is a reciprocally proportional correspondence between the demanded total fuel supply and the offset. This is shown as a straight, inclined second part of the third curve C3, where the offset is R % at the third predetermined fuel quantity Q and 0% at the first predetermined fuel quantity P.

An inclined, straight, fourth curve C4 shows a fourth embodiment in which the offset is reciprocally proportional to the demanded fuel quantity calculated in S1 in the fuel quantity range between the second predetermined fuel quantity Z and the first predetermined fuel quantity P. The offset is R % at the second predetermined fuel quantity Z and zero when the demanded fuel quantity is equal to the first predetermined fuel quantity P. An offset calculation according to the third and fourth curves, C3 and C4 respectively, is especially advantageous if a cruise control system has taken over the control of the demanded fuel quantity since a total shut-off of fuel injection to cylinders is undesired during cruise control. This is due to that the noise caused by hydraulic instability is lower if the fuel supply is not completely shut-off to a cylinder and because cruise control may go on for a relatively long time.

Other types of curves may of course also be used, such as a non-linear, fifth curve C5.

It is obvious that instead of showing the offset for a cylinder as a function of a demanded fuel quantity of a single cylinder in FIG. 6, the offset as a function of the demanded total fuel quantity calculated in step S1 could have been appended instead of FIG. 6, since such an alternative figure would show curves of the same types as the curves C1-C5.

A demanded fuel quantity for a cylinder, in FIG. 1 shown as a fuel quantity E, within the range A may due to the hydraulic instability create problems for the control of the fuel injection. Through the offset determination and calculation of a new demanded fuel quantity for each cylinder according to the steps S3 and S4, the cylinders 4*a* in the first group gets a higher quantity of fuel, which is above the range A. This is illustrated with a first dot D1. The cylinders in the second group gets a lower quantity of fuel, which is below the range A. This is illustrated with a second dot D2. Hence problems associated with range A is avoided.

In a UIS having a fuel quantity actuator for every cylinder of the engine, each cylinder can be controlled individually and not in groups of three as in the system discussed above in conjunction with FIG. 3. However in both these types of UIS, every two cylinders in a predetermined ignition order for the cylinders may belong to the first group and the remaining cylinders belong to the second group. It is of course also possible to leave out one or more cylinders, so that the left out cylinders are not affected by the invention. Such embodiments would however not be as beneficial as if all the cylinders were affected by the invention.

The invention claimed is:

1. A computer program embodied in a computer-readable medium comprising code causing an apparatus to function to control a supply of fuel to a combustion engine having a first group of cylinders and a second group of cylinders, wherein the code causes the apparatus to function to:

determine when a demanded total fuel quantity to the combustion engine is below a first predetermined total fuel quantity;

calculate a value for increasing and decreasing the fuel supply to the combustion engine as function of the demanded total fuel quantity; and increase the fuel supply to the first group of cylinders by the value, and decrease the fuel supply to the second group of cylinders by substantially the same value, wherein the apparatus increases the fuel supply to the first group of cylinders and decreases the fuel supply to the second group of cylinders when the apparatus determines that the demanded total fuel quantity to the combustion engine is below the first predetermined total fuel quantity.

2. In combination, the computer program embodied in the computer-readable medium of claim 1, and a vehicle, including the combustion engine;

an electronic control unit in the vehicle, wherein the electronic control unit includes the computer-readable medium that embodies the computer program. and further wherein the electronic control unit controls the fuel supply to the combustion engine in the vehicle.

3. A method for controlling supply of fuel to a combustion engine having a first group of cylinders and a second group of cylinders, the method comprising the steps of:

determining if a demanded fuel quantity to one of the cylinders is below a first predetermined fuel quantity;

and, if the demanded fuel quantity to the one cylinder is below the first predetermined fuel quantity, increasing the fuel supply to the first group of cylinders with a value determined by the demanded fuel quantity and decreasing the fuel supply to the second group of cylinders with substantially the same value.

4. A method according to claim 3, wherein the value is reciprocally proportional to the demanded fuel quantity on at least a part of a demanded fuel quantity range between zero demanded fuel quantity and the first predetermined fuel quantity.

5. A method according to claim 4, wherein the value is reciprocally proportional to the demanded fuel quantity in the whole demanded fuel quantity range between a second predetermined fuel quantity and the first predetermined fuel quantity, the second predetermined fuel quantity being smaller than the first predetermined fuel quantity.

6. A method according to claim 4, wherein the value is highest and constant in a demanded fuel quantity range between a second predetermined fuel quantity and a third predetermined fuel quantity, which is larger than the second predetermined fuel quantity, but lower than the first predetermined fuel quantity.

7. A method for controlling supply of fuel to a combustion engine having a first group of cylinders and a second group of cylinders, the method comprising the steps of:

determining if a demanded total fuel quantity to the combustion engine is below a first predetermined total fuel quantity;

and, if the demanded total fuel quantity to the combustion engine is below the first predetermined total fuel quantity, increasing the fuel supply to the first group of cylinders with a value determined by the demanded total fuel quantity and decreasing the fuel supply to the second group of cylinders with substantially the same value.

8. A method according to claim 7, wherein the value is reciprocally proportional to the demanded total fuel quantity on at least a part of a demanded total fuel quantity range between zero demanded total fuel quantity and the first predetermined total fuel quantity.

9. A method according to claim 8, wherein the value is reciprocally proportional to the demanded total fuel quantity in the whole demanded total fuel quantity range between a second predetermined total fuel quantity and the first predetermined total fuel quantity, the second predetermined total fuel quantity being smaller than the first predetermined total fuel quantity.

10. A method according to claim 8, wherein the value is highest and constant in a demanded total fuel quantity range between a second predetermined total fuel quantity and a third predetermined total fuel quantity, which is larger than the second predetermined total fuel quantity, but lower than the first predetermined total fuel quantity.

11. A method according to claim 7, wherein the value is always less than 100%.

12. A method according to claim 7, wherein the steps are performed during at least a part of a gear shifting procedure controlled by an electronic control unit for semi-automatic or automatic gear shifting.

13. A method according to claim 7, wherein the steps are performed when an automatic cruise control system for a vehicle controls the combustion engine.

14. A method according to claim 7, wherein the fuel supply is increased to every two cylinders of all cylinders of the engine and decreased to the other cylinders of the engine according to an ignition order for all the cylinders of the engine.

* * * * *